US005950900A

United States Patent [19]

Frommelt et al.

[11] Patent Number: 5,950,900

[45] Date of Patent: Sep. 14, 1999

[54] EXPLOSIVE POWDER CHARGED OPERATED SETTING TOOL

[75] Inventors: Markus Frommelt, Schaan, Liechtenstein; Norbert Heeb, Buchs, Switzerland; Hermann Kuel, Frastanz, Austria

[73] Assignee: Hilti Aktiengesellschaft, Schaan, Liechtenstein

[21] Appl. No.: 08/780,078

[22] Filed: Dec. 23, 1996

[30] Foreign Application Priority Data

Dec. 27, 1995 [DE] Germany ..... 195 48 870

[51] Int. Cl.[6] ..... B25C 1/08

[52] U.S. Cl. ..... 227/9

[58] Field of Search ..... 227/9, 10, 11

[56] References Cited

U.S. PATENT DOCUMENTS

| | | | |
|---|---|---|---|
| 2,724,116 | 11/1955 | Termet . | |
| 2,904,787 | 9/1959 | De Caro | 227/10 |
| 3,083,692 | 4/1963 | Reynolds . | |
| 3,115,637 | 12/1963 | Elliott | 227/10 |
| 3,285,131 | 11/1966 | Lewis | 227/9 |
| 4,349,141 | 9/1982 | Olliver et al. | 227/10 |
| 4,358,041 | 11/1982 | Ollivier | 227/10 |
| 4,585,077 | 4/1986 | Bergler | 173/13 |
| 4,651,912 | 3/1987 | Hawkins | 227/9 |
| 4,941,391 | 7/1990 | Ehmig et al. | 227/10 |
| 5,269,450 | 12/1993 | Popovich et al. | 227/10 |
| 5,538,172 | 7/1996 | Jochum et al. | 227/10 |
| 5,544,801 | 8/1996 | Schick | 227/110 |

FOREIGN PATENT DOCUMENTS

| | | |
|---|---|---|
| 0346275 | 12/1989 | European Pat. Off. . |
| 1034612 | 6/1955 | France . |
| 2518925 | 7/1983 | France . |
| 2518926 | 7/1983 | France . |
| 4313504 | 10/1994 | Germany . |

*Primary Examiner*—Jessica J. Harrison
*Assistant Examiner*—John Paradiso
*Attorney, Agent, or Firm*—Brown & Wood, LLP

[57] ABSTRACT

An explosive powder charge operated setting tool includes an axially extending piston guide (4) for a driving piston (6) and a retaining device (9) for the driving piston. The driving piston (6) has an axially extending shank (7) terminating in a head (8). The retaining device (9) has at least one radially displaceable ball (11) bearing against a conically-shaped inner surface of an annular spring washer (10) laterally enclosing the ball, and the ball is displaceable to a limited extent parallel to the axial direction of the piston guide (4) in a holding part (12) of the piston guide (4) open towards the shank (7) of the driving piston (6). The leading end of the driving piston has at least one circumferentially extending recess (13) which cooperates with the ball (11) of the retaining device (9).

7 Claims, 1 Drawing Sheet

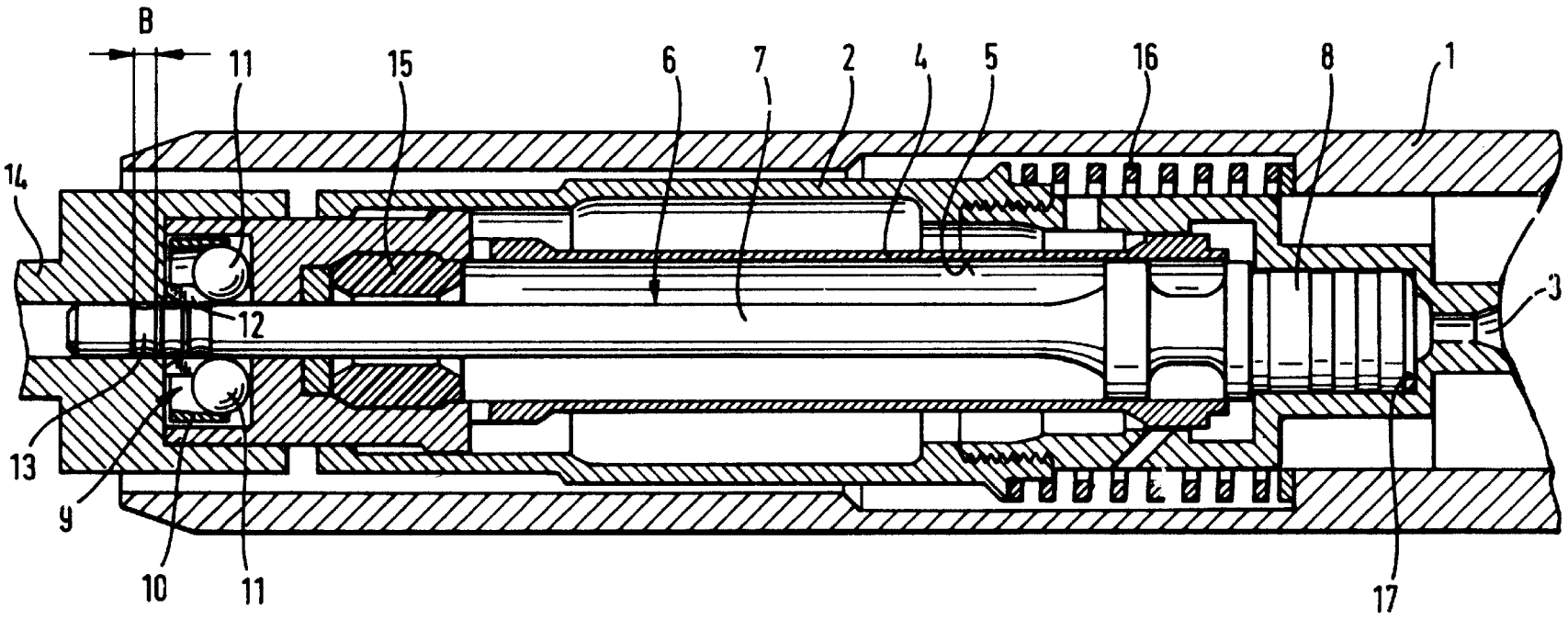
1
8
16
5
4
2
7
6
15
11
B
14
3
17
12
11
10
9
13

EXPLOSIVE POWDER CHARGED OPERATED SETTING TOOL

BACKGROUND OF THE INVENTION

The present invention is directed to an explosive powder charge operated setting tool having a support member including a cartridge chamber at one end with a piston guide axially displaceable within the support member, and a driving piston located in the piston guide and having a cylindrical shank extending axially in the driving direction from a head. The driving piston is driven by propelling gases generated from an explosive powder charge contained in the cartridge chamber and is axially displaced from a trailing initial position into a leading driven position. A retention device for the driving piston includes at least one radially displaceable ball bearing against a conically shaped inside surface of an annular spring washer. The ball is displaceable to a limited extent parallel to the axial direction of the piston guide in a holding part open towards the shank of the driving piston.

An explosive powder charged operated setting tool is disclosed in DE 43 13 504 A1 containing a supporting member with a cartridge chamber, a piston guide positioned within and displaceable relative to the support member, a driving piston mounted in a guide bore in the piston guide, and a retaining arrangement. The driving piston is displaceable through a volume, formed by the guide bore in the piston guide and by a portion of the support member, by propelling gases generated by an explosive powder charge ignited in the cartridge chamber. The driving piston is formed of a cylindrical shank with a head at one end. The retaining arrangement is formed by a receptacle in the piston guide open in the radial direction towards the cylindrical shank of the driving piston, with two balls resting on the shank and an annular spring washer enclosing the balls. The length of the receptacle parallel to the length of the driving piston is greater than the diameter of the balls. The annular spring washer has a conically shaped inside surface in contact with the balls and inclined relative to the axis of the driving piston and forming an angle sloping outwardly in the direction opposite to the driving direction of the piston.

If the driving piston moves slightly in the driving direction, the balls roll in the driving direction. The balls rolling on the conically shaped inside surface of the annular spring washer press against the washer radially outward and also are pressed by the flexural force of the spring washer radially inward against the shank of the driving piston, so that an automatic displacement of the driving piston in the setting direction especially due to gravity is prevented. During the driving operation, the driving piston is accelerated in the setting direction by the very high energy developed by the explosive powder charge. In comparison, the retaining force acting on the shank by the retaining arrangement is negligibly small, so that the retaining force does not have a harmful effect on the acceleration of the driving piston.

In particular, if the driving piston is accelerated by excessive energy, the piston strikes, after driving a fastening element, at a high velocity against a surface of the support member in the region of the cartridge chamber facing in the setting direction and then rebounds moving again in the driving direction, so that it does not return into its initial position. During a subsequent driving operation, the driving piston cannot be sufficiently accelerated, whereby the fastening element cannot be driven into the receiving material for a sufficient depth.

SUMMARY OF THE INVENTION

Therefore, the primary object of the present invention is to provide an explosive powder charged operated setting tool in which the driving piston can be securely held and retained in its initial position even if it is acted upon by excessive driving energy.

In accordance with the present invention, the shank of the driving piston has in its leading end region at least one circumferentially extending recess cooperating with the ball of a retaining device.

During a driving operation, the driving piston is accelerated in the driving direction by propelling gases generated when an explosive powder charge, located in the cartridge chamber, is ignited. A holding or retaining device is activated providing a frictional force with only a negligible effect on the acceleration of the driving piston.

At the same time of the acceleration of the driving piston in the driving direction, a displacement of the supporting member takes place opposite to the driving direction relative to the piston guide and to a housing, so that the axial length of the volume through which the driving piston traverses, and formed by the piston guide and a part of the supporting member, is increased. A spring abutting against the housing and cooperating with the supporting member is prestressed. After the driving piston drives a fastening element into a receiving material, the driving piston rebounds at high speed against a surface of the supporting member facing in the driving direction and located in the region of the cartridge chamber.

At that moment, the length of the volume through which the driving piston traverses is still greater than in the off position of the setting tool, and the recess located in the leading end region of the shank can clear the region of the ball in the retaining device. The driving piston moves in the driving direction after its rebound from the surface of the supporting member in the region of the cartridge chamber. Again, the recess contacts the ball in the retaining device and a positively locked connection or engagement is established between the two parts. Because of this positively locked connection and the axial movement of the driving piston in the driving direction, the retaining device is actuated very rapidly so that the piston does not move further in the driving direction.

After the driving piston has reached its end position, the prestressed spring, located between the supporting member and the housing, moves the supporting member in the driving direction. A displacement of the supporting member relative to the piston guide takes place, so that the length of the volume traversed by the piston is shortened. At the same time, the surface of the supporting member in the region of the cartridge chamber facing in the driving direction comes into contact with a surface of the piston head facing opposite to the driving direction and pushes the driving piston, in front of it in the driving direction, until the initial position of the driving piston and the support member relative to the housing has been reached. The force of the spring is of such a strength, that the retaining force of the retaining device is overcome and the positively locked connection between the shank and the ball is released. In the initial position of the driving piston, the circumferential recess is located between a leading end region of the piston guide and the retaining device. Because of the buckling stiffness and the notch effect of the shank, the bottom of the recess is preferably formed in the shape of a section or arc of a circle.

A complete positively locked connection between the shank of the driving piston and the ball is obtained if in a preferred arrangement the radius of the circular section of the recess corresponds essentially to the radius of the ball.

A driving piston driven by excess energy strikes the surface of the support member facing in the driving direction at a high speed. As a result, the rebound from such surface is quite strong, so that the driving piston moves very rapidly in the driving direction. The retaining device, developing only a distinct retaining force, can securely engage the driving piston, and the shank of the piston has several axially spaced circumferentially extending recesses for establishing a positively locked connection with the ball in the retaining device. The retaining device is actuated if one ball registers with the recess. If the kinetic energy of the driving piston is greater than the retaining force, the ball is displaced radially outward and the next recess receives the ball and the retaining device is again actuated. If the retaining force of the retaining device is still insufficient, there is a further radial disengagement of the ball and the retaining device is activated, until the driving piston stops. For reasons of mechanical strength of the shank of the driving piston, the shank has three such recesses arranged one after the other in the axial direction. In the initial position of the driving piston all three recesses are located between the leading end region of the piston guide and the ball in the retaining device.

The width of the recesses measured in the axial direction of the shank is preferably substantially the same, so that the force required for the radial disengagement of the braking ball from the recess is of equal magnitude independently of the initial position of the driving piston.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

BRIEF DESCRIPTION OF THE DRAWING

The drawing is an axially extending sectional view of an explosive powder charge operated setting tool embodying the present invention and illustrating the basic tool parts in the position when the leading end of the tool is pressed against a receiving material into which a fastening element is to be driven.

DETAILED DESCRIPTION OF THE INVENTION

In the drawing, the explosive powder charge operated setting tool of the present invention is pressed against a receiving material, not shown, into which a fastening element, not shown, is to be driven. The fastening element is supported within a fastening element guide 14 located at the leading end of the setting tool, the left end in the drawing. Adjacent the trailing end of the fastening element guide 14, in the leading end region of a piston guide 4, there is a retaining device 9.

An axially extending driving piston 6 is displaceably supported in a guide bore 5 of the piston guide 4. The driving piston 6 is formed of an axially extending shank 7 extending from a leading end to a head 8 at the trailing end of the piston. In the drawing, the driving piston 6 is located in its initial trailing position relative to the piston guide 4. The shank 7 at its leading end region has three circumferentially extending recesses 13 of equal length B in the driving direction and spaced closely apart, with the base of the recesses 13 formed of a section of a circle. An elastic damping element 15, for damping the driving piston 4, is arranged in the leading end region of the piston guide 4 rearwardly of the retaining device 9.

The retaining device 9 is located at the leading end of the piston guide 4 and adjacent a trailing end region of the fastening element guide 14 and is made up of two balls 11 located diametrically opposite one another, an annular spring washer 10 laterally enclosing the balls. The annular spring washer 10 can flex in a radial direction and has a conically shaped inside surface contacting the balls 11, and the inside surface is inclined to the axis of the driving piston and forms an angle opening opposite to the driving direction. A holding part 12 which is a part of the piston guide 4, serves for housing the balls 11 and has axial length parallel to the axial length of the driving piston 6 greater than the diameter of one of the balls 11.

The piston guide 4 is enclosed by a support member 2 extending axially within an axially extending housing 1. The piston guide 4 is axially displaceable relative to the support member 2. A cartridge chamber 3 is located in a trailing end region of the supporting member for an explosive powder charge, not shown. The cartridge chamber 3 is in communication through a bore to the inside space of the supporting member 2 and to the interior of the guide bore 5 formed by the piston guide 4.

The support member 2 located in the housing 1 can be displaced relative to the housing 1. A spring 16 extends axially between the housing 1 and a surface on the support member for returning the support member 2 to its initial position relative to the housing 1, after the support member 2 has moved opposite to the driving direction during a fastening element driving operation. The driving piston 6 supported in the piston guide 4 is displaceable or traversable through an axially extending volume formed by the guide bore 5 in the piston guide 4 and by a trailing end portion of the support member 2 which trailing end portion has an inside shape matched to the outside shape of the piston head 8.

During a driving operation, the driving piston 6 is accelerated in the driving direction by propelling gases generated when an explosive powder charge is ignited in the cartridge chamber 3. During the driving operation, the two balls 11 of the retaining device 9 roll along the holding part 12 of the piston guide 4 until they reach the end of the holding part 12 opposite to the driving direction. The balls 11 cooperate with a conically shaped inside surface of the annular spring washer 10 during such rolling, while the spring washer 10 is radially prestressed. The annular spring washer 10 presses the balls 11 radially inwardly against the shank 7 of the driving piston producing friction between the shank and balls. Such friction is of a negligibly small amount compared to the energy accelerating the driving piston 6 in the driving direction, whereby such friction does not have a negative effect on the acceleration of the driving piston.

Simultaneously with the acceleration of the driving piston 6 in the driving direction, a displacement of the support member 2 relative to the piston guide 4 and the housing 1 takes place opposite to the driving direction, whereby the traversed length or volume is increased. The spring 16 cooperating with the support member 2 and bearing against the housing 1 is prestressed. After a fastening element has been driven into the receiving material, the driving piston 6 rebounds at high speed towards the surface 17 of the support member 2 which faces in the driving direction and is located in the region of the cartridge chamber 3.

At this time, the traversed length or volume is still greater than in the non-operational state of the setting tool, and the driving piston performs a longer axial stroke, so that the recesses 13, located in the leading end region of the shank 7, can travel through the region of the balls 11 in the retaining device 9. During the subsequent rebound of the driving piston 6 from the surface 17 of the support member 2, the driving piston 6 moves in the driving direction. Again, the recesses 13 contact the balls 11 of the retaining device 9 and one or more consecutive positively locked connections are established. The retaining device 9 is actuated faster by the positively locked connections, whereby the driving piston 6 cannot move further in the driving direction.

Essentially simultaneously with the actuation of the retaining device 9, the prestressed spring 16 located between the support member 2 and the housing 1, moves the support member in the driving direction with a relative displacement of the support member with respect to the piston guide 4, so that the traversed length or volume is again shortened. At the same time, the face 17 of the support member 2 directed in the driving direction in the region of the cartridge chamber 3 contacts a trailing end surface of the head 8 facing opposite to the driving direction and pushes the driving piston 6 ahead of it in the driving direction, until the initial position of the driving piston 6 and of the support member 2 relative to the housing 1 is again reached. The force developed by the spring 16 is of such a magnitude that the retaining force of the retaining device is overcome and the positively locked connection between the shank 7 and the balls is released. In the initial position of the driving piston 6 the circumferentially extending recesses 13 are located ahead of the retaining device 9.

The base of the recesses 13 is shaped like a section of a circle and the radius of the circle of the section corresponds to the radius of one of the balls 11, so that a complete positively locked connection between the shank 7 of the driving piston 6 and the balls 11 can be established.

While specific embodiments of the invention have been shown and described in detail to illustrate the inventive principles, it will be understood that the invention may be embodied otherwise without departing from such principles.

What is claimed is:

1. An explosive powder charge operated setting tool comprising an axially extending support member (2) having a leading end and a trailing end relative to a driving direction of the setting tool, a cartridge chamber located in a trailing end region of said support member, an axially extending piston guide (4) having a leading end and a trailing end relative to the driving direction of the setting tool axially displaceably supported within said support member (2), an axially extending driving piston (6) axially displaceable within a guide bore (5) in said piston guide and having a leading end and a trailing end with a shank (7) extending from the leading end thereof towards the trailing end to a head having a larger outside diameter than the shank (7) extending from said shank to the trailing end of said piston, said driving piston arranged to be driven from an initial trailing position into a leading driven position for driving a fastening element into a receiving material by propelling gases generated when an explosive powder charge is ignited in said cartridge chamber, means for effecting a positively locked engagement with said shank (7) of said driving piston when said driving piston rebounds from the trailing end region of said support member in the driving direction after driving a fastening element and rebounding to the trailing end region of said support member comprising a retaining device (9) for said driving piston (6) located in a leading end region of said support member and comprising an annular spring washer (10) with a conically shaped inside surface extending in the driving direction and at least one radially displaceable ball abutting radially outwardly against said conically shaped inside surface of said annular spring washer (10) laterally enclosing said ball, said conically shaped inside surface tapering inwardly in the driving direction of the setting tool, said ball being displaceable to a limited extent in the driving direction in a holding part (12) formed in the leading end region of said piston guide (4) and said holding part being open towards said shank (7) so that said ball can be displaced radially inwardly towards said shank, said means for effecting a positively-locked engagement including that said shank (7) having at least one circumferentially extending recess (13) arranged perpendicularly of the driving direction in a leading end region thereof arranged to receive said ball in positively locked engagement as said piston (6) rebounds in the driving direction.

2. An explosive powder charge operated setting tool, set forth in claim 1, wherein said recess (13) has a base formed as an arc of a circle.

3. An explosive powder charge operated setting tool, as set forth in claim 2, wherein the base of said recess (13) has a radius corresponding to a radius of the ball (11).

4. An explosive powder charge operated setting tool, as set forth in one of claims 1–3, wherein said shank (7) has several said recesses (13) spaced closely apart in the driving direction.

5. An explosive powder charge operated setting tool, as set forth in claim 4, wherein said shank (7) has three said recesses.

6. An explosive powder charge operated setting tool, as set forth in claim 4, wherein said recesses (13) measured in the driving direction have a dimension (B) the same for each said recess.

7. An explosive powder charge operated setting tool, as set forth in claim 5, wherein said recesses (13) measured in the driving direction have a dimension (B) the same for each said recess.

* * * * *